US007360737B2

(12) United States Patent
Pfeifer et al.

(10) Patent No.: US 7,360,737 B2
(45) Date of Patent: Apr. 22, 2008

(54) DEVICE FOR STORING BAGS

(75) Inventors: Georg Pfeifer, Schwaebisch Hall (DE); Harald Mittnacht, Igersheim (DE)

(73) Assignee: Optima Filling and Packaging Machines GmbH, Schwaebish Hall (DE)

( * ) Notice: Subject to any disclaimer, the term of this patent is extended or adjusted under 35 U.S.C. 154(b) by 0 days.

(21) Appl. No.: 10/511,687

(22) PCT Filed: Apr. 12, 2003

(86) PCT No.: PCT/EP03/03810

§ 371 (c)(1),
(2), (4) Date: Mar. 22, 2005

(87) PCT Pub. No.: WO03/086927

PCT Pub. Date: Oct. 23, 2003

(65) Prior Publication Data

US 2005/0150989 A1 Jul. 14, 2005

(30) Foreign Application Priority Data

Apr. 15, 2002 (DE) ..... 102 17 241

(51) Int. Cl.
*B65H 39/14* (2006.01)

(52) U.S. Cl. ..... 242/528

(58) Field of Classification Search ..... 242/528, 242/541.3; 53/430, 118

See application file for complete search history.

(56) References Cited

U.S. PATENT DOCUMENTS 4,349,123 A * 9/1982 Yang
4,500,307 A * 2/1985 Bridgeman
4,688,368 A * 8/1987 Honegger
5,167,377 A * 12/1992 Chalmers
5,197,727 A * 3/1993 Lotto et al.
5,779,180 A * 7/1998 Smedt et al.
6,168,558 B1 * 1/2001 Vinberg

FOREIGN PATENT DOCUMENTS

| | | |
|---|---|---|
| DE | 1 916 130 B | 6/1971 |
| DE | 28 04 178 | 8/1979 |
| DE | 28 04 178 B2 | 8/1979 |
| DE | 30 40 021 C2 | 5/1982 |
| DE | 195 05 277 A1 | 5/1996 |
| DE | 196 27 158 A1 | 1/1998 |
| DE | 197 49 825 A1 | 5/1999 |
| DE | 101 34 508 A | 1/2003 |
| DE | 101 34 508 A1 | 1/2003 |
| DE | 101 35 760 A1 | 1/2003 |
| EP | 0 014 246 A | 8/1980 |
| EP | 1 050 501 A2 | 11/2000 |

OTHER PUBLICATIONS

International Search Report dated Jul. 23, 2003.
German Search Report dated Aug. 22, 2003.

* cited by examiner

*Primary Examiner*—William A Rivera
(74) *Attorney, Agent, or Firm*—Boyle Fredrickson, S.C.

(57) ABSTRACT

For interim storage for stacks of plastic bags, it is proposed to wind these up with the aid of a single film, or two films, to form a roll. The bag stacks here are oriented such that their opening sides, which preferably have a tab with holes, are oriented forward, as seen in the unwinding direction. During the unwinding operation, a gripping means can grip the leading edge of the bags and feed the same to the packaging machine.

6 Claims, 1 Drawing Sheet

DEVICE FOR STORING BAGS

BACKGROUND OF THE INVENTION

The invention is based on a device with the aid of which bags can be stored or stored on an interim basis, to be precise in such a manner that they can then be processed by a packaging machine.

DE 195 05 277 A1 has already disclosed a device for the interim storage of flat objects, the latter, for example sections of tubing, being wound up in stacks. The stacks are spaced apart from one another.

DE 196 27 158 A1 also discloses such a device, in the case of which stacks of bags are wound up in an imbricated manner.

The object of the invention is to make it possible to store bags for packaging machines in such a way that, instead of individual bags, stacks of bags are introduced into the packaging machine, it being possible to change, if appropriate, the size of the bags.

SUMMARY OF THE INVENTION

Whereas, in the case of the known devices, the orientation of the individual bags is irrelevant, it is important for the present invention that the bags are oriented in stacks such that, as the roll is unwound, the opening side is oriented forward. At this point, the stacks of bags can be gripped by a gripping means and introduced into a feed means for the packaging machine. Packaging machines for which the device is intended required entire stacks of bags which all have to be arranged in a certain orientation.

For particularly high-speed packaging machines, which may also have a number of lines of bags, it may be provided, in a development of the invention, that the bags are arranged in an imbricated manner. The imbrication here is selected such that the abovementioned gripping means has sufficient space at the respective front bag stack in order to be able to grip the latter securely. It is possible to have arrangements for ensuring that, as the front bag stack is removed, the respectively following stack of bags does not slip or is carried along in part.

The bag stacks may be imbricated such that the leading edge of a bag stack is located beneath the trailing edge of the front bag stack or above the trailing edge of the front bag stack, as seen in the unwinding direction. In both cases, it can be ensured that, in the case of the respectively foremost bag stack, the leading edge and its adjoining region are free, with the result that the gripping means can readily act thereon. This is all the more important if, during the unwinding operation, the film forming the part of the roll is guided away over an unrolling roller, with the result that the front bag stack projects beyond this unrolling roller.

The device can be used, in particular, for processing bags which, in their opening region, have a tab with holes. Such bags can then be positioned as stacks, by the gripping means, on a feed means which has pins corresponding to the holes. The bags are thus arranged in a precise position on this feed means and can be fed without slippage to the further packaging machine.

The method proposed by the invention consists in combining the bags to form stacks in such a manner that the opening sides of the bags are always in one place. The bags are then wound up onto a winding-up roller to form a roll with the aid of a single film or of two films located one above the other. It is possible here for the bags to be arranged in an imbricated manner. This roll then forms the store for the interim storage of the bag stacks. The roll can be transported, the bags being accommodated in a space-saving manner.

BRIEF DESCRIPTION OF THE DRAWINGS

Further features, details and advantages of the invention can be gathered from the following description of a preferred embodiment of the invention, from the patent claims and from the abstract, which is worded in relation to the contents of the description, and with reference to the drawing, in which:

DETAILED DESCRIPTION

Figure 1:
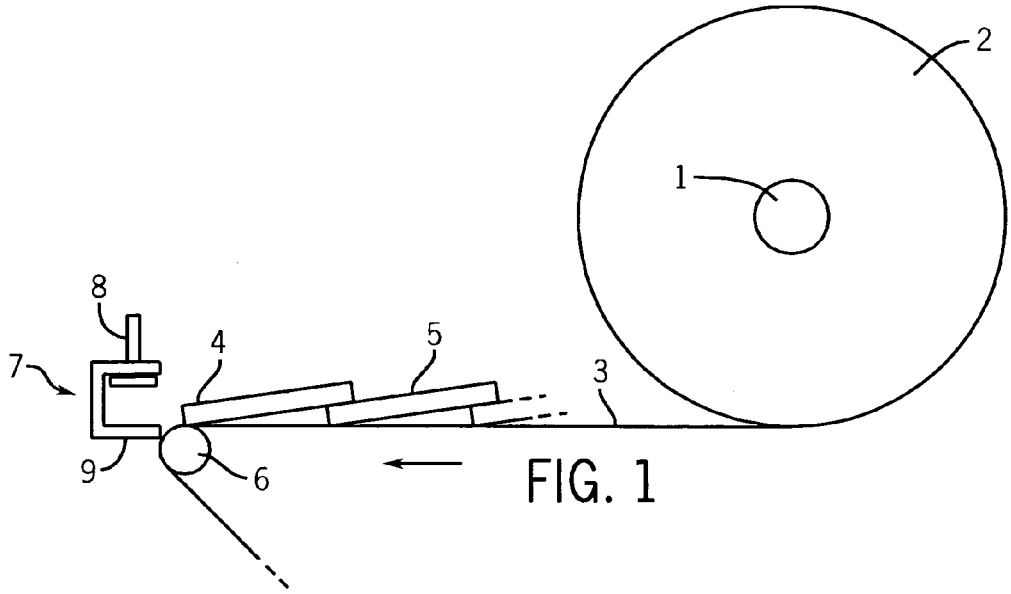
FIG. 1 shows a vastly simplified illustration of the device according to the invention in a first stage.

FIG. 1 illustrates, schematically, a device in which a roll 2 has been wound up on a winding-up roller 1. The roll 2 is formed by a band-like film 3 with stacks of bags located thereon having been wound up onto the core. This winding-up operation is known per se. During the winding-up operation, the bags are oriented such that their openings are arranged on the trailing side, as seen in the winding-up direction, with the result that the openings are located on the leading side 4 during the unwinding operation, as represented by the arrow in FIG. 1. The bags are combined to form stacks, FIG. 1 showing only a single bag stack 5. The stacks of bags have to be aligned, with the result that they form a defined leading edge and trailing edge. During the unwinding operation, the film 3 is guided rectilinearly, preferably horizontally, in a first instance and is then guided over a deflecting roller 6 such that an acute angle is produced between the two sections of the film 3. This means that the bag stack 5 is conveyed on horizontally and rectilinearly in the forward direction at the location of the deflecting roller, that is to say it projects beyond the roller 6.

Figure 2:
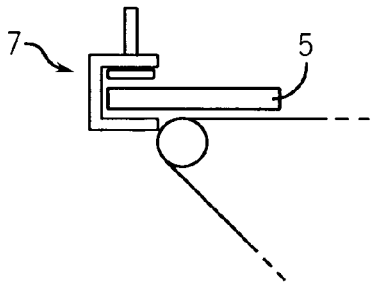
FIG. 2 shows the view of the leading edge during a later stage.
Figure 3:
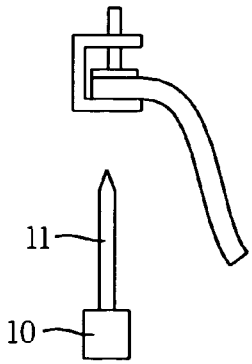
FIG. 3 shows the state in which the first bag stack is being removed.
Figure 5:
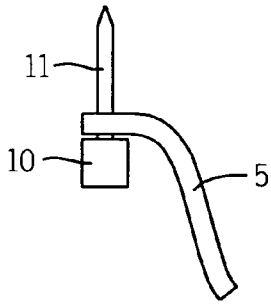
FIG. 5 shows the state where the bag stack has been transferred to the feed means of a packaging machine.

The device uses a gripping means 7 which, in simplified terms, contains a U-shaped profile with a securing means 8. The profile 9 is oriented such that the respectively front bag stack 5 is pushed into the profile 9. As soon as the bag stack 5 is arranged in the profile 9, see FIG. 2, the securing means 8 is actuated, with the result that the bag stack 5 is then secured in the profile 9. The gripping means 7 is then conveyed, with the aid of means which are not illustrated, to a feed means of a following packaging machine. This is illustrated schematically in FIG. 3. For each bag stack 5, the feed means contains, along a rail or a chain, two upwardly projecting pins 11 which are spaced apart from one another.

Figure 4:
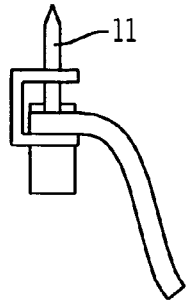
FIG. 4 shows a further stage.

On their leading side, that is to say on the side where the opening is located, the bags contain a single-sided tab with two holes. The spacing of the holes from one another corresponds to the spacing between the pins 11. The gripping means, then, is lowered from above in an aligned position, with the result that the pins 11 engage in the holes of the bags through incisions starting from the free side of the U-profile. Lowering the gripping means to the full extent results in the situation as is illustrated in FIG. 4. The securing means 8 is then released and the gripping means, with the profile 9, is drawn away to the side. The bags are then located as stacks on the feed means 10, from where they can be fed to the packaging machine in a direction perpendicular to the drawing plane.

The device proposed by the invention is suitable, in particular, for packing diapers or toilet rolls or, in general terms, for disposable hygiene articles.

The invention claimed is:

1. A device for storing bags, having a winding-up roller, a drive for the winding-up the roller, a roll which is arranged on the winding-up roller for unwinding in a direction opposite a winding-up direction and which comprises at least one film web and stacks of bags arranged thereon, such that the bags having openings that are arranged to face to the front, as the bags are unwound in the unwinding direction, and wherein the bags each have a front region adjacent their openings for gripping, said front region having a plurality of spaced apart holes for receiving pins of a gripping device.

2. The device as claimed in claim 1, wherein the bags are arranged in an overlapping manner.

3. The device as claimed in claim 2, wherein the overlapping is formed such that the leading edge of each bag is located beneath the respectively preceding bag stack in the unwinding direction.

4. The device as claimed in claim 1, wherein the unwound film web is guided over a deflecting roller.

5. The device as claimed in claim 1, having a gripping means for gripping the front region of a bag in the stack for transfer to a feed means for a packaging machine.

6. A method for storing bags on a interim basis, wherein the bags, combined to form stacks, are wound up with the aid of at least one film such that their open sides are oriented face forwardly, as seen in the unwinding direction;

wherein the bags are wound up with their longitudinal seams running perpendicular to a direction of winding for the bags;

wherein the bags each have a front region adjacent their open side for gripping, said front region having a plurality of spaced apart holes for receiving pins of a gripping device; and wherein the gripping device has pins for engaging the bags through the holes for further movement of the bags.

* * * * *